US007044322B2

(12) United States Patent
Owens et al.

(10) Patent No.: US 7,044,322 B2
(45) Date of Patent: May 16, 2006

(54) SPRING-LOADED SECONDARY SEAL FOR FLOATING-ROOF STORAGE TANK

(75) Inventors: John E. Owens, Cypress, TX (US); Roger J. Orner, Columbia, SC (US); Terry A. Gallagher, Wheaton, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 433 days.

(21) Appl. No.: 10/320,093

(22) Filed: Dec. 16, 2002

(65) Prior Publication Data

US 2004/0112897 A1 Jun. 17, 2004

(51) Int. Cl.
*B65D 88/46* (2006.01)

(52) U.S. Cl. ..... 220/224; 220/222

(58) Field of Classification Search ..... 220/216, 220/218, 221, 222, 225, 224
See application file for complete search history.

(56) References Cited

U.S. PATENT DOCUMENTS

| | | | | | |
|---|---|---|---|---|---|
| 2,536,019 | A | | 1/1951 | Allen | |
| 4,126,243 | A | | 11/1978 | Bruening | 220/224 |
| 4,138,032 | A | * | 2/1979 | McCabe | 220/224 |
| 4,287,999 | A | * | 9/1981 | Heisterberg | 220/222 |
| 4,308,968 | A | * | 1/1982 | Thiltgen et al. | 220/222 |
| 4,353,477 | A | | 10/1982 | Bruening | 220/224 |
| 4,493,430 | A | | 1/1985 | Sie | 220/224 |
| 4,615,458 | A | | 10/1986 | Grove et al. | 220/222 |
| 5,036,995 | A | | 8/1991 | Wagoner | |
| 5,284,269 | A | * | 2/1994 | Petrie et al. | 220/224 |
| 5,351,848 | A | * | 10/1994 | Wagoner | 220/224 |
| 5,515,989 | A | * | 5/1996 | Petrie et al. | 220/224 |
| 5,529,200 | A | | 6/1996 | Ford et al. | 220/218 |
| 5,667,091 | A | | 9/1997 | Slaber, Jr. et al. | |
| 6,247,607 | B1 | * | 6/2001 | King | 220/221 |
| 6,354,588 | B1 | | 3/2002 | Kuwahara et al. | 230/221 |

FOREIGN PATENT DOCUMENTS

| | | |
|---|---|---|
| EP | 0 781 715 A1 | 12/1996 |
| EP | 1 234 784 A1 | 2/2001 |

OTHER PUBLICATIONS

International Search Report on International (PCT) Application No. PCT/US 03/39790 dated Jun. 3, 2004.

* cited by examiner

*Primary Examiner*—Kien Nguyen
(74) *Attorney, Agent, or Firm*—Marshall, Gerstein & Borun LLP

(57) ABSTRACT

A low-profile secondary seal for floating-roof storage tanks has a tip seal that includes a series of segmental adapter plates connected to the shoe plates. A tip seal element is mounted on the adapter plates. A fabric extends between the tip seal and the floating roof. A pusher is hinged to the floating roof, and includes a pusher bar with two ends that are disposed in a sliding arrangement against the adapter plates. A spring is connected to the pusher at an inclined angle, providing a mechanical advantage as the spring biases the pusher and pusher bar outwardly against the plates, pressing the tip seal against the tank shell.

22 Claims, 4 Drawing Sheets

SPRING-LOADED SECONDARY SEAL FOR FLOATING-ROOF STORAGE TANK

BACKGROUND OF THE INVENTION

This invention relates generally to storage tanks having roofs that float on the surface of the stored product, and more particularly to secondary seals used in such tanks.

Floating roof tanks are widely used to store volatile petroleum-based liquids and limit the quantity of product evaporative emissions that may escape to the environment. Such tanks may be configured either as internal floating-roof tanks or as external floating-roof tanks. In each configuration, the floating roof is designed to remain in contact with the liquid surface of the product and to cover all of the surface of the product except for a small annular surface area between the outermost rim of the floating roof and the inside surface of the tank shell. A single primary rim seal may control product evaporative emissions from this annular area. However, for increased effectiveness, emissions from this annular area are conventionally controlled by a combination of perimeter rim seals, including a primary seal with a secondary seal mounted in the rim space above it.

Primary seals conventionally take the form of a piece of fabric extending between the floating roof and a shoe plate that bears on the tank shell. Examples of such seals are illustrated in Wagoner, U.S. Pat. No. 5,036,995 and in Ford et al, U.S. Pat. No. 5,529,200. Alternatively, primary seals may be in the form of resilient liquid- or foam-filled seals that arc supported from the floating roof.

Secondary seals for floating-roof tanks should span the distance between the floating roof and the tank shell. Most conventional secondary seals are mounted to the floating roof and extend upwards across the annular rim space to contact the tank shell some vertical distance above the floating roof. The vertical distance represents a characteristic clearance requirement for the secondary seal.

One prevalent type of secondary seal includes metal compression plates that attach to the floating roof and support a tip seal against the tank shell, as disclosed in Kinghorn et al., U.S. Pat. No. 4,116,358; Grove et al., U.S. Pat. No. 4,615,458; and Thiltgen et al., U.S. Pat. No. 4,308,968. In each of these designs, the compression plates are mounted at an angle to the tank shell.

The angle of the compression plates is critical. If the angle is too steep, the tip seal can become jammed against the tank shell as the seal attempts to pass over weld seams or other surface irregularities on the tank shell. If the angle is too shallow, the tip seal can drag against the tank shell or catch on a weld seam or other shell discontinuity. Either event may cause the compression plates to fold into the rim space and damage one or more sections of the secondary seal, opening gaps between the tip seal and the tank shell that can lead to increased evaporative emissions to the atmosphere.

Further, as a floating roof drifts toward one section of the tank shell, the angle of the compression plates becomes more vertical, increasing the vertical clearance required to keep the tip seal inside the tank and in contact with the tank shell. For a typical storage tank with a nominal 8" rim space, the width of the rim space at any particular point may actually vary between about 4" to more than 12" as the roof moves, increasing the vertical clearance requirement to as much as 24". Tank size or tank foundation considerations may also dictate a 10-inch or even 12-inch nominal width for the rim space, with permissible variations as large as ±7 inches or more. Consequently, the vertical clearance requirement for conventional secondary seals may sometimes exceed 31".

This vertical clearance requirement presents a problem both for new tanks and for retrofitting old tanks. New tanks must be designed with excess, unusable capacity to account for the required vertical clearance, adding to the construction cost. Similarly, when a secondary seal is added to an existing floating-roof tank, the maximum filling height of the tank may need to be reduced to accommodate the required vertical clearance for the secondary seal. Any such reduction of the maximum filling height represents lost inventory to the owner/operator of the tank. For example, when a secondary seal is added to an existing 100-foot (≈30 meter) diameter floating-roof tank, a nominal 2-foot (0.6 meter) reduction in filling height represents a loss of approximately 117,500 gallons (2800 Bbl) of product storage. Such a loss can significantly reduce the revenue of the owner/operator of the tank.

Hills et al., U.S. Pat. No. 4,339,052, discloses a secondary seal in the form of a tube that is connected near the top of the floating roof. One problem with this arrangement is that the secondary seal can rotate upwards, out of the rim space as the floating roof descends during product send-out operations. Petri et al., U.S. Pat. No. 5,284,269, discloses a space-saving double-seal system comprised of two shoe segments mounted above each other. One problem with this arrangement is that the shoe supports of the primary seal extend beneath the floating roof, increasing the risk of interference with equipment inside the tank. Allen et al., U.S. Pat. No. 2,536,019, discloses a combination primary/secondary seal that is spring-loaded and supported from the top of the floating roof pontoon. Although his arrangement would require a minimum vertical clearance, there are basic problems due to interaction between the primary shoe and the closely-mounted secondary tip seal. None of these seal configurations have found significant commercial success.

Because of disadvantages in previously-disclosed low-profile secondary seals, it is believed that there is a need for a new low-profile secondary seal that can be used to increase the storage capacity of existing floating-roof tanks currently equipped with conventional primary seals. Gallagher, U.S. Pat. No. 6,354,488 presents a low-profile secondary seal that can be used with a conventional primary seal utilizing shoe plates and a fabric seal. The tip seal is held against the tank shell by a resilient tube seal. While this low-profile secondary seal reduces the clearance required, there are alternative methods that will maintain tip pressure, possibly over a wider operating range with a lower clearance requirement.

SUMMARY OF THE INVENTION

The present invention describes such a low-profile secondary seal. It may also be used with a conventional primary seal utilizing shoe plates and a fabric seal. The secondary seal includes a tip seal positioned above the primary shoe plate by multiple, segmental tip adapter plates. Tip seal contact against the tank shell is maintained by a series of horizontally mounted, spring-loaded pushers that extend from the floating roof to the tip adapter plates. In use, the spring bears on tip adapters (via a spreader bar) with sufficient force to maintain the secondary tip seal and the upper portion of the shoe plates in close sealing engagement against the tank shell whether the roof is at a minimum or maximum rim space condition. A secondary fabric seal is located above the primary seal, housing all the secondary pushers. In some embodiments of the invention, the tip seal may be no more than about twelve inches above the top of the floating roof. It may include a tip adapter in the form of a series of inwardly-projecting plates on which the pusher acts. A rim plate adapter may be included to secure the pusher to the floating roof and keep the secondary fabric seal from becoming caught in the pusher. A fabric protector can be used to prevent water or debris from accumulating on the secondary fabric seal between the tip seal and the floating roof. Electrical shunts may be extended from the tip seal to the floating roof, and from the tip seal to the shell.

DETAILED DESCRIPTION OF THE DRAWINGS

Figure 1:
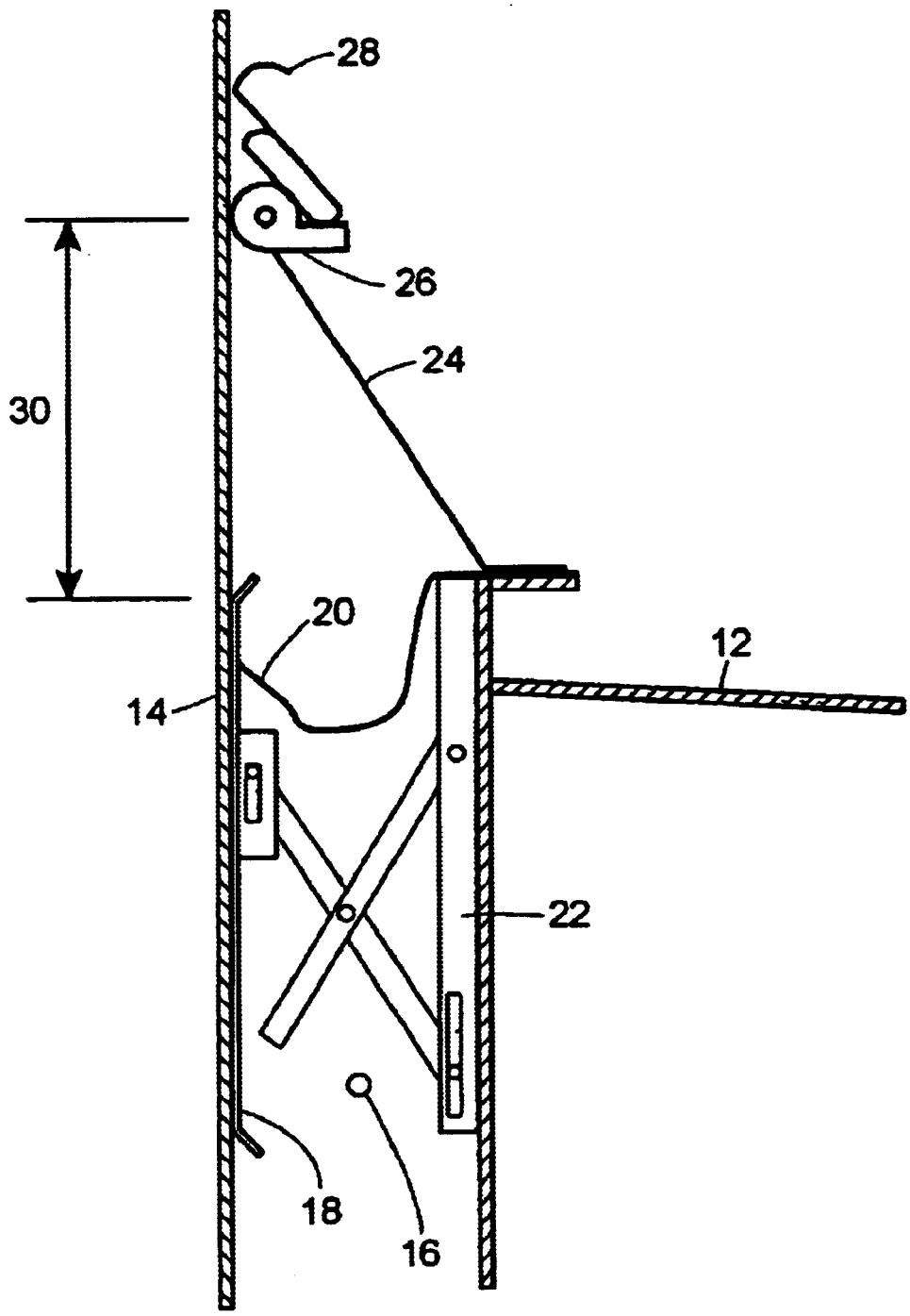
FIG. 1 Prior art
FIG. 1 is a cross-sectional view of a prior art secondary seal.

FIG. 1 illustrates a typical prior art secondary seal in an external, floating-roof tank. A floating roof 12 floats within a tank shell 14, leaving a rim space 16 between the roof and the shell. A fixed roof, spanning the entire tank or supported by columns, can also be added to create an internal floating-roof tank.

Multiple overlapping primary shoe plates 18 form a continuous primary seal against the inside surface of the tank shell 14. Each shoe plate is partially submerged in the stored product and extends above the liquid surface of the product to an elevation near the top of the floating roof 12. The rim space 16 is substantially closed by a primary seal 20 that is connected directly to the upper portion of each shoe plate 18 and extends to the floating roof 12. The individual shoe plates are held against the inside surface of the tank shell by a series of spring-loaded hangers 22. Typically, three hangers are used for each shoe plate. Each hanger generates sufficient force to ensure that a minimum gap is maintained between the shoe plates and the tank shell over the full operating rim space range. Minimizing the gap is desirable for good evaporative emission control.

In the illustrated prior art design, multiple metal compression plates 24 are attached to the outer rim of the floating roof 12 above the primary seal 20 to form part of a secondary seal. The compression plates are arranged in overlapping sequence to provide continuous coverage of the rim space 16. Sections of tip seal 26 are secured to the upper flange of the compression plates, and bear against the tank shell. Individual electrical shunts 28 are installed as extensions of the compression plates 24, and are disposed at equal spacing around the floating-roof perimeter. The vertical clearance requirement 30 between the tip seal element 26 and the top of the floating roof 12 represents lost storage capacity in the tank.

Figure 2:
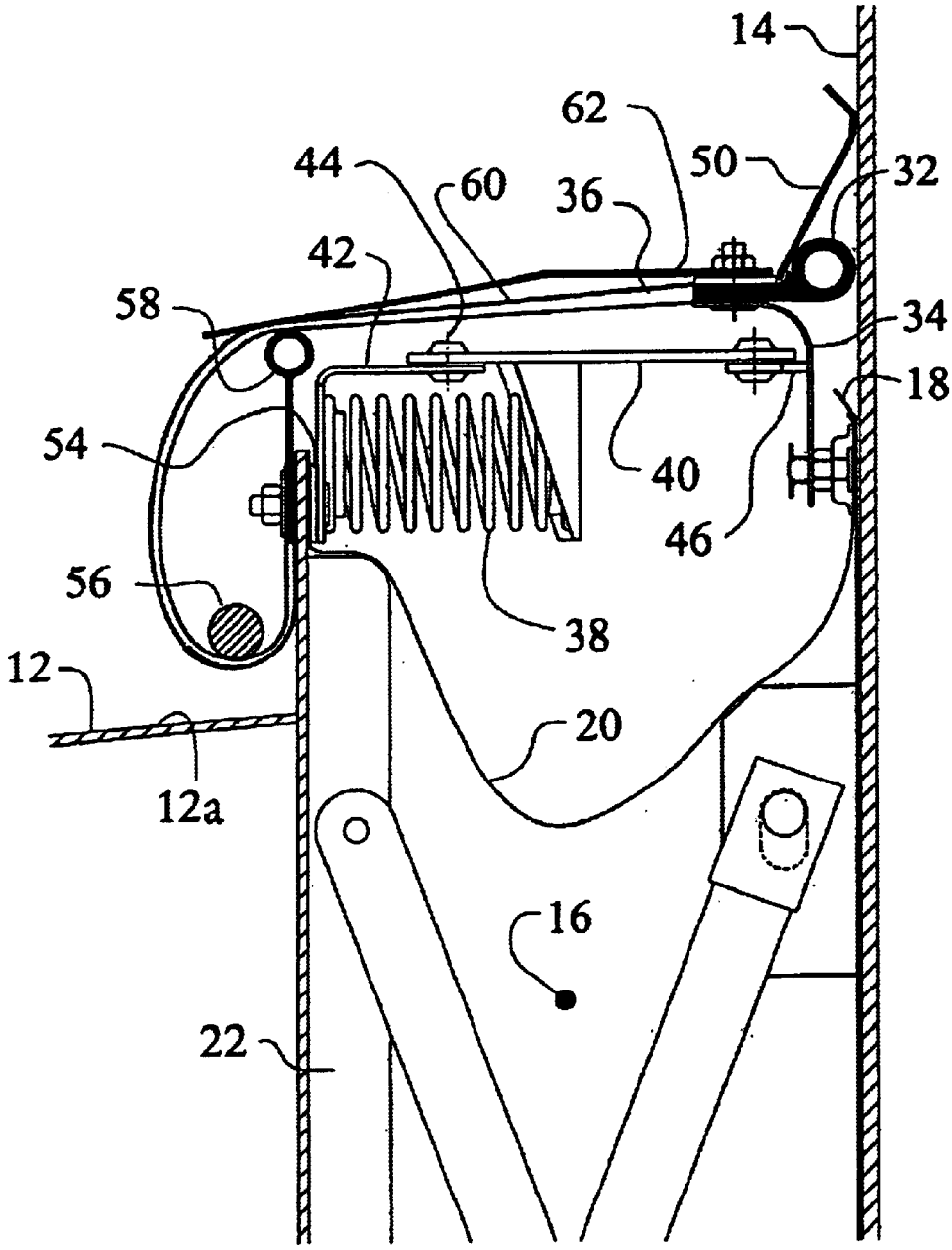
FIG. 2 is a cross-sectional view of one embodiment of a secondary seal in accordance with the present invention.
Figure 3:
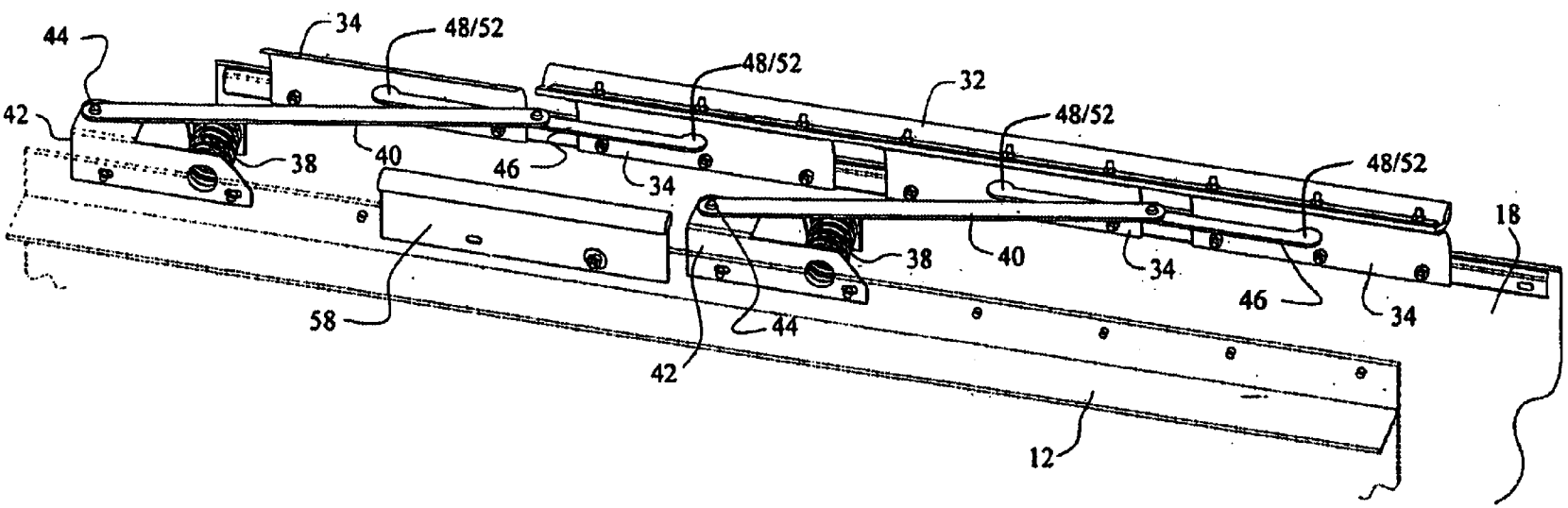
FIG. 3 is a perspective view of the secondary seal seen in FIG. 2, with the fabric removed for clarity.

FIGS. 2 and 3 illustrate a storage tank in which a new, low-profile, spring-loaded secondary seal is installed. The tank includes a primary seal 20 that seals the rim space 16 between the floating roof 12 and the tank shell 14. The primary seal 20 can be of any conventional mechanical shoe seal design, but should keep the rim space substantially closed over the full rim space range. As illustrated, the primary seal includes conventional shoe plates 18 and spring-loaded hangers 22. In the embodiment of the invention seen in FIGS. 2 and 3, a secondary tip seal assembly includes a conventional tip seal 32 and multiple adapter plates 34. The position of the tip seal is new. The tip seal is no more than about twelve inches above the top deck 12*a* of the floating roof 12. The adapter plates 34 are supported from the upper section of the shoe plates and are set in a sequential configuration, as seen in FIG. 3. Each adapter plate 34 extends upwardly from a shoe plate 18 and includes a mounting flange on which the tip seal 32 is disposed.

The secondary seal also includes a fabric barrier 36 that covers the rim space 16 between the floating roof 12 and the tip seal 32. In the illustrated embodiment of the invention, the fabric barrier 36 is attached at one end to the floating roof 12 with the other end connected below the tip seal 32 on the mounting flange on the adapter plates 34.

Figure 4:
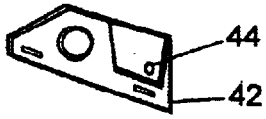
FIG. 4 is a perspective view of a mounting bracket that can be installed on a floating roof to serve as a base for a spring and pusher.
Figure 5:
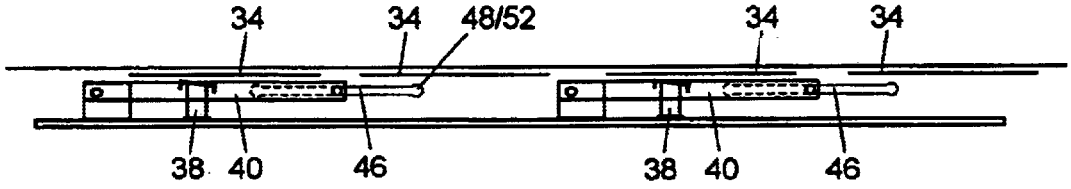
FIGS. 5–7 are top views showing movement of the secondary seal of FIG. 2 as the floating roof moves with respect to the tank shell.
Figure 6:
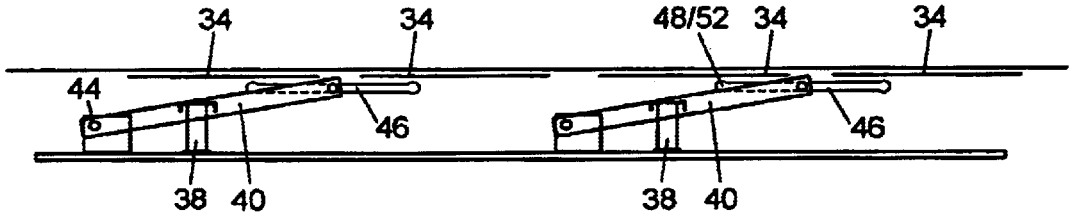
Figure 7:
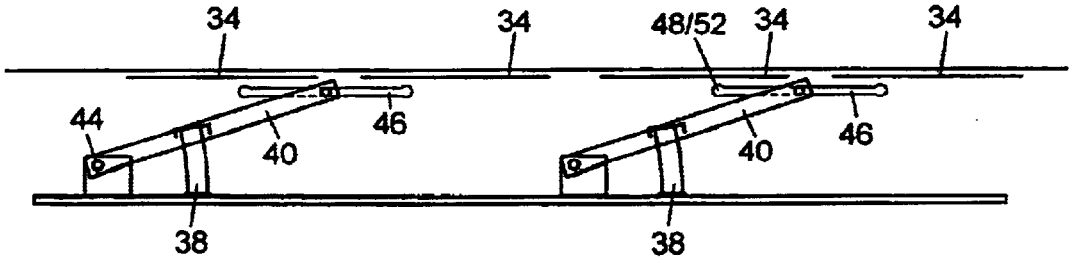

The secondary seal also includes a spring 38 and a pusher 40. The spring 38 biases the pusher outwardly from the floating roof 12. In the illustrated design, both the spring and the pusher are attached to a mounting bracket 42 on the floating roof. One possible mounting bracket is illustrated in FIG. 4. In that configuration, the inner end of the pusher 40 is connected to the mounting bracket at a hinge 44, and extends from the floating roof at a radially-oblique angle (i.e., the axis of the pusher does not intersect the centerline of the floating roof). Rather than being co-axial with the pusher 40, the illustrated spring 38 is connected to the pusher 40 at an inclined angle. In this configuration, the pusher, spring, and hinge form a lever, providing a mechanical advantage. The illustrated pusher 40 includes a pusher bar 46 at its outer end. The tip seal 32 is seated against the tank shell 14 by the force of the spring 38, which is leveraged by the pusher 40 and transmitted to the adapter plates 34 through two opposed ends 48 of the pusher bar 46. The pusher bar 46 is not affixed to the adapter plates 34, but instead presses against them to permit sliding along the adapter plates 34 as the rim space 16 changes in width with the shifting of the floating roof 12, as seen in FIGS. 5–7. The force of the pusher 40 on the adapter plates 34 may also reduce the gap between the tank shell 14 and the shoe plates 18, further helping to reduce emissions.

A conventional electrical shunt 50 with an extension 60 may be attached to the floating roof 12 to provide electrical continuity between the tank shell 14 and the floating roof. Insulated washers 54 at each mounting bracket bolt and insulating skid pads 52 at each end of the pusher bar 40 may be added to control electrical continuity between the floating roof 12 and the tank shell 14. The use of electrical insulators and shunts can reduce the effects of lightning strikes on the floating roof 12.

There are several structural details that can improve implementation of the invention, but are not a necessary part of the invention. For example, as seen in FIG. 2, a weight 56 in the fabric 36 can be used to weigh down the fabric and keep it taut above the rim space 16. In addition, a washer bar/fabric protector 58 can be connected to the floating roof 12 beneath the fabric 36. Such a protector can prevent the fabric from rubbing against the pusher 40 or other components of the tank, extending the life of the fabric 36. A separate weather barrier may be added above fabric barrier 36 to prevent water or debris from accumulating between the tip seal 32 and the floating roof 12, and providing a smooth, sloped surface from the tip seal 32 to the floating roof 12.

This detailed description has been given for clarity of understanding only. It is not intended and should not be construed as limiting the scope of the invention, which is defined in the following claims.

We claim:

1. A secondary seal in a liquid storage tank that has a tank shell, a floating roof, and a primary seal that is connected to the floating roof and to a shoe plate adjacent the tank shell, the secondary seal comprising:

a tip seal assembly adjacent to the tank shell and connected to the shoe plate;

a fabric barrier above the primary seal joining the tip seal assembly to the floating roof;

a pusher disposed against the tip seal assembly; and a spring attached to the floating roof and configured to press the pusher against the tip seal assembly with sufficient force to maintain the tip seal assembly in sealing engagement against the tank shell.

2. A secondary seal as recited in claim 1, in which the pusher is connected to the floating roof at a hinge, and the spring is connected to the pusher at an inclined angle.

3. A secondary seal as recited in claim 1, in which the pusher is disposed in a sliding arrangement against the tip seal assembly.

4. A secondary seal as recited in claim 1, in which the pusher extends from the floating roof at a radially-oblique angle.

5. A secondary seal as recited in claim 1, in which the tip seal assembly comprises a tip seal element that is mounted on an adapter plate that projects inwardly from the shoe plate.

6. A secondary seal as recited in claim 1, in which the tip seal assembly includes a tip seal element that is no more than about twelve inches above a top deck of the floating roof.

7. A secondary seal as recited in claim 1, in which the tip seal assembly comprises a set of adapter plates installed in a sequential configuration.

8. A secondary seal as recited in claim 1, and further comprising an electrical shunt attached to the floating roof and to the tip seal assembly, and disposed to remain in contact with the tank shell.

9. A secondary seal as recited in claim 1, in which an insulator is disposed between the floating roof and the tank shell.

10. A secondary seal as recited in claim 1, in which a weather barrier is disposed above the fabric barrier.

11. A secondary seal as recited in claim 1, in which the tip seal assembly comprises an adapter plate, and the pusher bar has two ends disposed against the adapter plate.

12. A secondary seal as recited in claim 1, in which the spring is also disposed to maintain the shoe plate in sealing engagement against the tank shell.

13. A liquid storage tank comprising:

a tank shell;

a floating roof within the tank shell;

a primary seal connected to the floating roof and to a set of shoe plates that bear against the tank shell; and a secondary seal comprising:

a tip seal adjacent to the tank shell and connected to an adapter plate;

a fabric barrier above the primary seal joining the tip seal to the floating roof;

a pusher disposed against the adapter plate; and a spring attached to the floating roof and configured to press the pusher against the adapter plate with sufficient force to maintain the tip seal in sealing engagement against the tank shell.

14. A liquid storage tank as recited in claim 13, in which the pusher is connected to the floating roof at a hinge.

15. A liquid storage tank as recited in claim 13, in which the pusher is disposed in a sliding arrangement against the adapter plate.

16. A liquid storage tank as recited in claim 13, in which the pusher extends from the floating roof at a radially-oblique angle.

17. A method for installing a secondary seal in a liquid storage tank having a tank shell, a floating roof, and a primary seal that is connected to both the floating roof and to a shoe plate adjacent the tank shell, the method comprising:

supporting a tip seal assembly above the shoe plate adjacent the tank shell;

installing a fabric barrier between the floating roof and the tip seal assembly, above the primary seal;

installing a pusher against the tip seal assembly; and mounting a spring to press the pusher against the tip seal assembly with sufficient force to maintain the tip seal assembly in sealing engagement against the tank shell.

18. A method as recited in claim 17, in which the pusher is hinged to the floating roof.

19. A method as recited in claim 17, in which the pusher is disposed in a sliding arrangement against the tip seal assembly.

20. A method as recited in claim 17, in which the pusher is installed at a radially-oblique angle to the floating roof.

21. A method as recited in claim 17, in which the pusher is installed at a radially-oblique angle to the floating roof, and the spring is connected to the pusher at an inclined angle.

22. A secondary seal for a liquid storage tank that has a tank shell, a floating roof, and a primary seal that is connected to the floating roof and to a shoe plate adjacent the tank shell, the secondary by comprising:

a tip seal assembly adapted for being mounted adjacent to the tank shell and being connected to the shoe plate;

a fabric barrier that is connected to the tip seal assembly and adapted for being disposed above the primary seal and connected to the floating roof;

a pusher disposed against the tip seal assembly; and a spring that presses the pusher against the tip seal assembly and is adapted for being attached to the floating roof and pressing the pusher against the tip seal assembly with sufficient force to maintain the tip seal assembly in sealing engagement against the tank shell.

* * * * *

UNITED STATES PATENT AND TRADEMARK OFFICE

CERTIFICATE OF CORRECTION

PATENT NO. : 7,044,322 B2
APPLICATION NO. : 10/320093
DATED : May 16, 2006
INVENTOR(S) : John E. Owens et al.

It is certified that error appears in the above-identified patent and that said Letters Patent is hereby corrected as shown below:

In the Claims:

At Column 6, line 46, "by" should be -- seal --.

Signed and Sealed this

Twenty-ninth Day of May, 2007

JON W. DUDAS
*Director of the United States Patent and Trademark Office*